US006601837B2

(12) United States Patent
Klimach et al.

(10) Patent No.: US 6,601,837 B2
(45) Date of Patent: Aug. 5, 2003

(54) CLAMPING DEVICE

(75) Inventors: Horst Klimach, Kernen (DE); Siegfried Foshag, Neuhausen (DE); Karl Philipp, Bietigheim-Bissingen (DE); Hans Roesch, Gemmrigheim (DE)

(73) Assignee: Bessey & Sohn GmbH & Co, Bietigheim-Bissingen (DE)

( * ) Notice: Subject to any disclaimer, the term of this patent is extended or adjusted under 35 U.S.C. 154(b) by 0 days.

(21) Appl. No.: 10/209,965

(22) Filed: Aug. 1, 2002

(65) Prior Publication Data

US 2003/0030205 A1 Feb. 13, 2003

Related U.S. Application Data

(63) Continuation of application No. PCT/EP00/00817, filed on Feb. 2, 2000.

(51) Int. Cl.[7] ..... B25B 1/00
(52) U.S. Cl. ..... 269/6
(58) Field of Search ..... 269/203, 6, 3, 269/165–171.5, 147–150; 81/487

(56) References Cited

U.S. PATENT DOCUMENTS

| | | | |
|---|---|---|---|
| 4,989,847 | A | 2/1991 | Chapman |
| 5,096,170 | A | 3/1992 | Albin |
| 5,853,168 | A | 12/1998 | Drake |

FOREIGN PATENT DOCUMENTS

| | | |
|---|---|---|
| CA | 2304718 | 2/1999 |
| DE | 39 17 473 | 2/1990 |
| DE | 296 03 811 | 5/1996 |
| DE | 197 31 579 | 1/1999 |
| DE | 299 08 240 | 9/1999 |
| DE | 299 19 066 | 12/1999 |
| GB | 2 221 641 | 2/1990 |

*Primary Examiner*—Robert C. Watson
(74) *Attorney, Agent, or Firm*—Barry R. Lipsitz; Douglas M. McAllister

(57) ABSTRACT

In order to provide a clamping device with a clamping rail which is guided for displacement in its longitudinal direction and an actuating device which comprises a gripping element, by means of which the clamping rail can be displaced, which has a great ease of operation it is suggested that a first contact element and second contact element be held on the clamping rail, that the clamping rail be displaceable in relation to the first contact element and that the first contact element be rotatable relative to the actuating device.

48 Claims, 7 Drawing Sheets

CLAMPING DEVICE

The present disclosure relates to the subject matter disclosed in International application No. PCT/EP00/00817 of Feb. 2, 2000, which is incorporated herein by reference in its entirety and for all purposes.

BACKGROUND OF THE INVENTION

The invention relates to a clamping device with a clamping rail guided for displacement in its longitudinal direction and an actuating device which comprises a gripping element, by means of which the clamping rail can be displaced.

It is known from DE 299 08 240 U1 to arrange a clamping bar with a stationary counterstop so as to be pivotable on a housing of the actuating device in such a clamping device.

It is known from U.S. Pat. No. 4,989,847 to provide a detachable contact bar.

Proceeding from this state of the art, the object underlying the invention is to provide a clamping device which is simple to operate.

SUMMARY OF THE INVENTION

This object is accomplished in accordance with the invention, in a clamping device of the type described at the outset, in that a first contact element and a second contact element are held on the clamping rail, that the clamping rail is displaceable in relation to the first contact element and that the first contact element is rotatable relative to the actuating device.

As a result of the inventive clamping device, the contact elements seated on the clamping rail may also be aligned in relation to a workpiece during any one-handed operation without the actuating device needing to be turned or grasped. In addition, a contact element may be turned unlimitedly since no parts of the housing are in the way. As a result of the non-displaceability of the first contact element, a contact surface may, on the one hand, be made available for the clamping of a workpiece (this may also take place, in principle, by means of a contact surface of the actuating device itself), wherein, on the one hand, the rotatability of this contact element, the adjustment of a certain distance between the first contact element and the second contact element and a rotatability, which does not alter the relative alignment of the two contact elements during the rotation of the clamping rail, can be achieved in a simple manner with respect to production techniques.

In principle, the rotatability of the first contact element may be brought about in that this can be rotated against the clamping rail and/or the clamping rail can be rotated with the first contact element.

In the case of an embodiment which is simple from a constructional point of view and advantageous from the point of view of production techniques, the clamping rail is guided so as to be non-rotatably displaceable. The first contact element is then rotatable relative to the clamping rail. In particular, the second contact element is then designed to be rotationally symmetric transversely to the clamping rail. When the first contact element is turned, the relative orientation between the first and the second contact element is, nevertheless, not altered.

In a particularly advantageous embodiment, the clamping rail is mounted for rotation on the actuating device, wherein first and second contact elements are rotatable with the clamping rail. As a result, a set relative orientation of the contact elements transversely to the clamping rail is also maintained during rotation relative to the actuating device.

Advantageously, the clamping rail is unlimitedly rotatable with the contact elements held on it in order to obtain manifold possibilities for use.

It is particularly favorable from a constructional point of view when the clamping rail is guided for displacement by at least one bearing element. As a result, the displaceability of the clamping rail is ensured. The clamping rail is, in particular, guided for sliding displacement by the bearing element.

It is particularly advantageous when the bearing element itself is mounted for rotation on the actuating device in order to also ensure the rotatability of the clamping rail in this way.

For this purpose, a bearing element favorably guides the clamping rail so as to be non-rotatable and slidingly displaceable, i.e., the clamping rail is not rotatable relative to the bearing element and the rotation of the clamping rail is brought about via the rotation of the bearing element. It is then advantageous when the clamping rail has a profile which is designed such that the rotatability of the clamping rail can be blocked in relation to a bearing element, by means of which the clamping rail is guided for displacement.

In an advantageous embodiment it is provided for the clamping rail to have a flat profile, for example, a rectangular profile. Such a clamping rail may be produced inexpensively and during operational use is less susceptible to damage which could interfere with the sliding displaceability.

In an alternative embodiment which is, in particular, simple to produce, a bearing element guides the clamping rail so as to be rotatable and slidingly displaceable, i.e., such a bearing element is designed as a rotary slide bearing.

It is particularly favorable from the point of view of production techniques when at least one bearing element is designed as a deep-groove bearing which is arranged on the actuating device so as to be non-displaceable and rotatable by means of a groove. Such a deep-groove bearing may be produced in an inexpensive manner and also assembly of an inventive device is possible in a simple manner since only one such deep-groove bearing need be used and no additional securing means, such as screws, are necessary.

Furthermore, it is favorable from a constructional point of view when the first contact element is held on the housing of the actuating device via a deep-groove bearing so as to be non-displaceable and rotatable with the clamping rail. For example, the first contact element may be connected to the deep-groove bearing in one piece or in a form-locking manner. As a result, a slidingly displaceable mounting of the clamping rail is achieved, on the one hand, and, on the other hand, a rotary mounting. Furthermore, it is possible for the first contact element to be turned with the clamping rail and, therefore, its orientation in relation to the second contact element is also maintained during the rotation. In addition, the first contact element is held, as a result, on the housing of the actuating device so as to be non-displaceable so that the distance between the first contact element and the second contact element is altered during a displacement of the clamping rail in a constructionally simple manner.

The inventive clamping device may be operated in a simple manner when the gripping element comprises a handle arranged on the actuating device so as to be pivotable. In this respect, a respective handle can be present, in particular, for each direction of movement of the clamping rail or also only one single handle.

It is particularly favorable from a constructional point of view when at least one advancing element is provided which is arranged and designed such that it can be tilted contrary to the direction of displacement of the clamping rail in order to block the displaceability of the clamping rail in relation to the advancing element and that it is movable in the direction of displacement of the clamping rail. As a result, the clamping rail can be advanced in one direction in a simple manner during the actuation of the gripping element. An advancing element is advantageously arranged in the housing of the actuating device so as to be rotatable in order to ensure the rotatability of the clamping rail.

An advancing element is favorably tiltable and movable via a force acting on it by way of the gripping element.

When a pressure spring is arranged between an advancing element and a blocking element or holding element for exerting a restoring force on the advancing element contrary to the direction of displacement, the advancing element may be pushed back in a simple manner into its initial position, from which a further advancing of the clamping rail can be actuated.

In this respect, the blocking element is favorably arranged on a housing of the actuating device so as to be rotatable in order to bring about a rotary guidance of the clamping rail in this manner which is to a great extent free from play.

The blocking element or the holding element can favorably be brought into a blocking position, in which a displaceability of the clamping rail is blocked in one direction. This blocking element ensures that the clamping rail can be displaced only in a desired direction of advance whereas the displacement in the opposite direction is blocked. As a result, good clamping results can be obtained since the force acting on a workpiece, which is transferred due to the displacement of the clamping rail, is effective only in one direction.

A great ease of operation is achieved when a holding element is provided, by means of which the displaceability of the clamping rail can be blocked in one direction. Such a holding element, by means of which a blocking element can be held in a non-blocking position, is associated, in particular, with the blocking element. The blocking position may be set or discontinued (i.e. the non-blocking position may be set) in a simple manner via the holding element which may be moved, in particular, from outside the housing of the actuating device.

In this respect, the holding element can favorably be actuated independently of the gripping element so that the one-handed operability, in particular, is maintained.

The holding element is advantageously arranged on the actuating device so as to be non-rotatable in order, on the one hand, not to hinder the rotatability of the clamping rail and, on the other hand, to fulfill its holding function.

The holding element can favorably be fixed in a holding position, wherein a blocking element which is possibly provided is in a non-blocking position in the holding position. This prevents any jamming of the blocking element with the clamping rail and ensures in this way the displaceability of the clamping rail in the desired direction. In this respect, it is particularly advantageous when the holding element can be fixed in a holding position, in which the holding element is aligned essentially at right angles to the clamping rail. The sliding displaceability of the clamping rail is not hindered in such a right-angled position.

The holding element may be fixed in its holding position by means of a coupling pin in a simple manner from a constructional point of view and from the point of view of production techniques.

A contact surface for an advancing element, which limits the displaceability of an advancing element in the direction opposite to the direction of displacement of the clamping rail, is favorably formed in a housing of the actuating device. As a result, it is ensured that the advancing element is always pushed back into its initial position and can be brought into a position, in which it does not hinder the displacement of the clamping rail.

It is particularly advantageous when the actuating device is designed to be essentially in mirror symmetry to a central plane transversely to the direction of displacement of the clamping rail. As a result, it is possible in a simple way for the clamping rail to be displaceable in two opposite directions and, therefore, to be usable, in particular, as a clamping element and as a spreading element.

In this respect, a displacement of the first and the second contact elements towards one another and away from one another can favorably be actuated via the gripping element. As a result, a great ease of operation is made available since not only a clamping tool but also a spreading tool can be actuated via a one-handed operation.

A first advancing element is favorably provided for the displacement of the clamping rail in a first direction of displacement and a second advancing element for the displacement in an opposite direction. The displacement mechanism may then be essentially of the same design, irrespective of the direction of displacement, whereby the constructional expenditure is reduced.

It is particularly advantageous when first and second advancing elements can be tilted in opposite directions. As a result, a displacement of the clamping rail may be brought about, in particular, via gripping levers which can be pivoted in opposite directions.

In this respect, a first gripping lever of the gripping element favorably engages on the first advancing element and a second gripping lever on the second advancing element. As a result, the clamping rail may be displaced in the desired direction of displacement by an operator in a simple manner with great ease of operation.

It is particularly favorable from a constructional point of view when the first and second gripping levers can be pivoted in opposite directions for engagement on the associated advancing elements.

In an alternative embodiment, a gripping lever is provided, by means of which the first advancing element or the second advancing element may be displaced depending on the direction of pivoting.

It is particularly favorable from a constructional point of view when a first pressure spring, a first holding element and, optionally, a first blocking element are associated with the first advancing element and a second pressure spring, a second holding element and, optionally, a second blocking element are associated with the second advancing element.

It is particularly favorable when the first and second holding elements can be coupled to one another such that when the first blocking element is in a blocking position the second blocking element is in a non-blocking position and vice versa. As a result, it is possible in a constructionally simple manner for the clamping rail to be displaceable each time only in one direction whereas the displacement in the opposite direction is blocked. As a result, it is possible for the displacement of the clamping rail to be a pure "clamping displacement" or a pure "spreading displacement", with which a force can be exerted on a workpiece in one direction (either clamping direction or spreading direction).

In this respect, a coupling device is favorably provided which can be secured on the actuating device in a first position, in which the first blocking element is fixed in a non-blocking position via the associated, first holding element and the second blocking element is in a blocking position, and can be secured in a second position, in which the first blocking element is in a blocking position and the second blocking element is fixed in a non-blocking position via the associated, second holding element. The direction of displacement of the clamping rail may be changed over as a result of the coupling device which can be arranged, for example, in the housing as a slidable element or can be a separate push-on element.

In its blocking position, the first blocking element is favorably tilted in a direction opposite to the second advancing element during its displacement and, accordingly, the second blocking element is tilted in a direction opposite to the first advancing element during its displacement. Such a tilting of the blocking element in a direction opposite to the associated advancing element facilitates a displacement of the advancing element itself since the displacement, with which the clamping rail is displaced as well, acts contrary to the tilting of the blocking element and, therefore, its blocking position is cancelled out for the displacement in the direction of displacement of the clamping rail. The clamping rail is, however, not displaceable in the opposite direction due to this tilting since the blocking is effective in this direction.

Favorably, the second advancing element is secured against tilting in the first position of the coupling device and the first advancing element is secured against tilting in the second position. As a result, the adjustment and changing over of the direction of displacement are possible in a simple manner.

The inventive clamping device may be produced in an inexpensive manner when the housing of the actuating device is designed and provided with recesses such that the movable parts are fixed in relation to the housing solely via the recesses acting as contact surfaces. No screw connections or the like are then necessary but rather the parts are held solely via the recesses so that the clamping device can, in particular, be assembled quickly and easily.

The housing also protects the movement mechanism for the displacement of the clamping rail and grease or oil for increasing the smooth operation is not removed from the movable parts during the operative use.

It is particularly favorable when the housing of the actuating device comprises a first housing section and a second housing section which can be fixed to one another. The structural parts can then be inserted into the first housing section, whereupon the second housing section is then fixed to the first housing section. As a result, the corresponding parts are secured in the housing. The fixing of the two housing parts may be brought about in a simple manner, for example, via screw connections.

It may be provided for the first contact element and/or the second contact element to be designed as a contact bar or also as a contact disk.

A contact element favorably has contact surfaces which are essentially of the same design transversely to the longitudinal direction of the clamping rail. As a result, such a contact element can be used not only for clamping a workpiece on a contact surface but also for spreading it at the other contact surface. In addition, the first contact element and the second contact element favorably have contact surfaces which are essentially of the same design, whereby the ease of operation is increased since a simple use in relation to clamping and spreading is, in particular, made possible.

In one embodiment which allows a high variability of use, the first contact element and/or second contact element are rotatable in relation to the clamping rail, for example, in that such a contact element is rotatable in a rotary bearing which is seated non-rotatably on the clamping rail. As a result, the contact elements can, on the one hand, be turned with the clamping rail, wherein their relative orientation is maintained and, on the other hand, the relative orientation may be adjusted.

In a further embodiment, a coupling element is provided, by means of which the first contact element and the second contact element can be coupled to one another such that they are turned with the clamping rail during rotation thereof. It is then sufficient to secure one contact element non-rotatably on the clamping rail. The other contact element is taken along during rotation of the clamping rail via the coupling element.

A rotatability of a contact element relative to the clamping rail may be achieved in a simple manner in that the contact element is seated on the clamping rail by means of a rotary bearing.

The following description of preferred embodiments of the invention serves to explain the invention in greater detail in conjunction with the drawings.

DETAILED DESCRIPTION OF THE DRAWINGS

Figure 1:
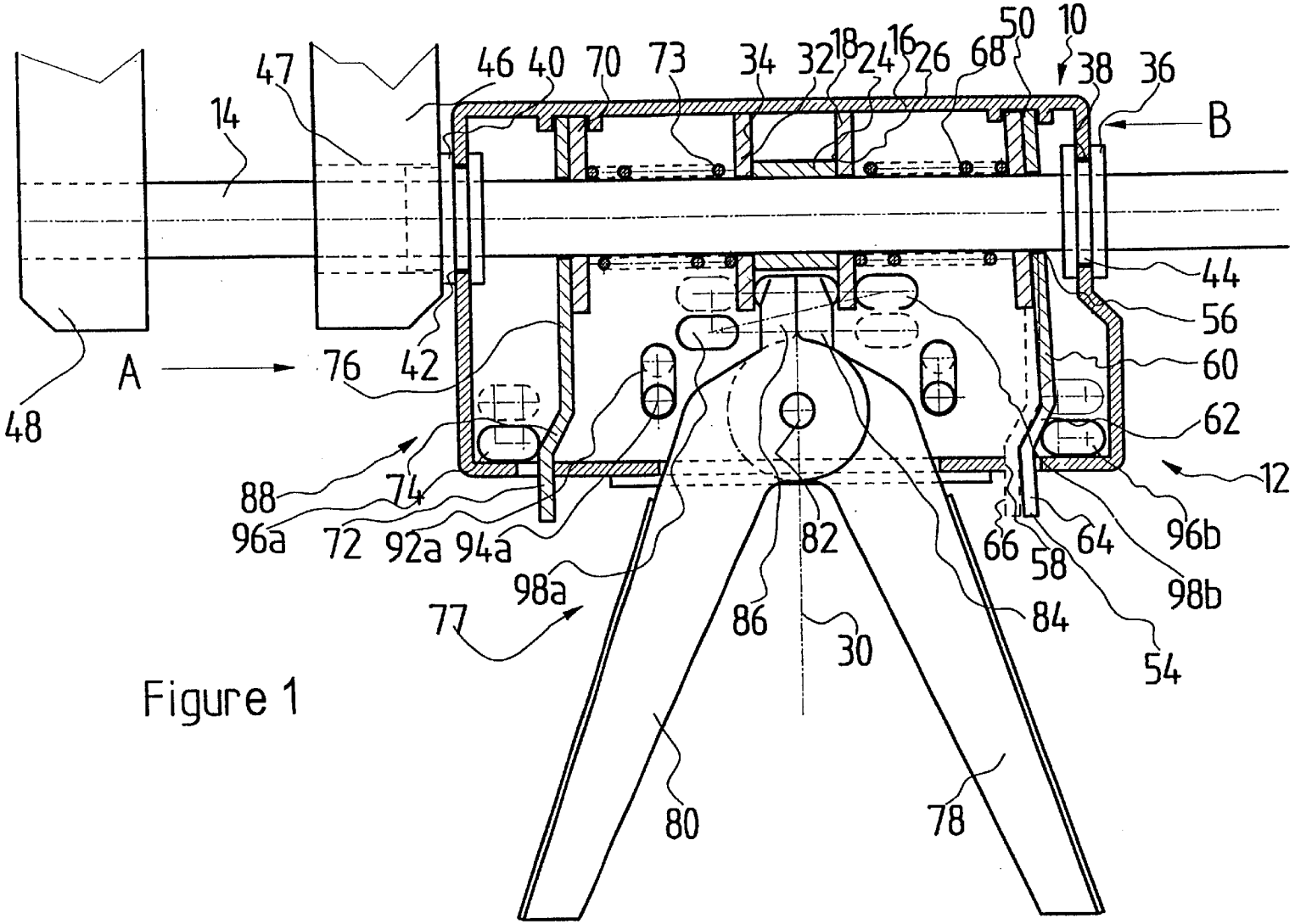
FIG. 1: shows a sectional side view of a first embodiment of an inventive clamping device.

A first embodiment of an inventive clamping device, which is designated in FIG. 1 as a whole as 10, comprises an actuating device 12 and a clamping rail 14 which is guided for displacement on the actuating device 12 and the displacement of which can be actuated via the actuating device 12.

The actuating device 12 has a housing 16 and, in particular, a closed housing, in which the clamping rail 14 is guided for sliding displacement. The clamping rail 14 has, in one variation of one embodiment, a flat profile and an essentially rectangular cross section, as shown in FIG. 4, in particular with lateral recesses.

Figure 4:
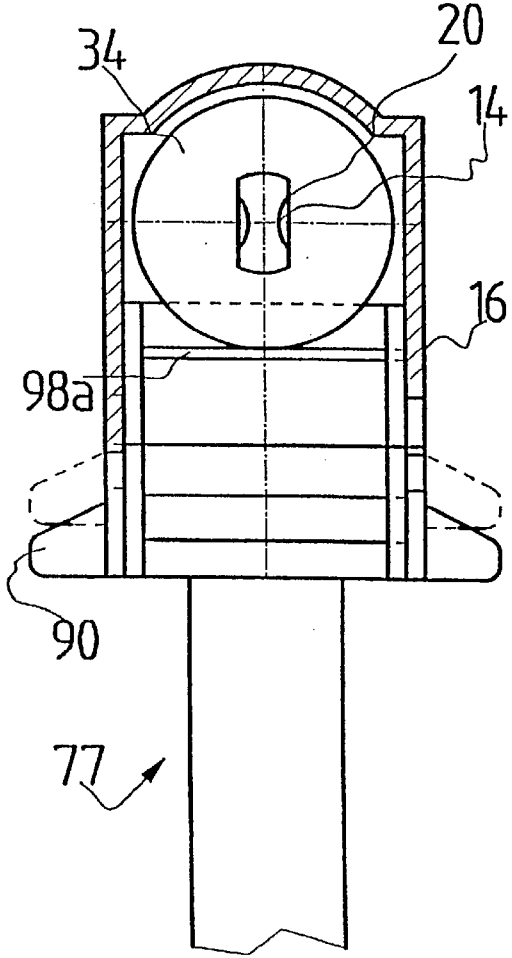
FIG. 4: shows a sectional view along line X—X in FIG. 3.

A first bearing element 18 in the form of a bearing disk is arranged in the housing 16 of the actuating device 12 for the displaceable guidance of the clamping rail 14, this bearing disk having a recess 20 which is arranged centrally and in which the clamping rail 14 is guided for sliding displacement (FIG. 4). The recess 20 is designed such that the clamping rail 14 cannot be rotated against the first bearing element 18.

The first bearing element 18 is rotatably arranged in the housing 16, wherein a block element 24 of the housing 16 with an end face 26 makes an, in particular, annular contact surface available for the first bearing element 18 which is oriented at right angles to a longitudinal direction of the clamping rail 14.

The block element 24 is seated, in the variation of one embodiment shown, symmetrically and, in particular, in mirror symmetry to a central plane 30 of the actuating device 12. A contact surface for a second rotatable bearing element 34 is formed by an end face 32 of the block element 24 located opposite the end face 26 and the second bearing element is of the same construction as the first bearing element 18 and the clamping rail 14 is likewise guided through it.

For the purpose of displaceably guiding the clamping rail 14, a first deep-groove bearing 36 is arranged, in addition, at a first opening 38 for the clamping rail 14 through the housing 16 and a second deep-groove bearing 40 is arranged at a second opening 42 of the housing 16 which is located opposite the first opening 38. Such a deep-groove bearing 36, 40 is formed by a disk-like element which is provided on its cylinder surface with a groove-like recess 44. This groove-like recess 44 has a width which corresponds essentially to the housing wall in the area of an associated opening 38, 42. As a result, such a deep-groove bearing 36, 40 may be inserted into the housing 16 via its groove-like recess 44, wherein it is not displaceable against the housing 16.

As a result of the cylindrical inner wall of the groove-like recess 44, the deep-groove bearing 36 is rotatably mounted in the first opening 38 and the second deep-groove bearing 40 is rotatably mounted in the second opening 42 in the case of a corresponding cylindrical configuration of the associated opening 38, 40. The deep-groove bearings 36 and 40 each have a recess which is of essentially the same configuration as the recess 20 (FIG. 4) in the first bearing element 18 and is arranged in alignment with this (and with the corresponding recess of the second bearing element 34) and in which the clamping rail 14 is guided for sliding displacement.

A first contact element 46 is connected to the second deep-groove bearing 40, for example, by way of form locking or in one piece. The first contact element 46 is designed, in particular, as a contact bar which is oriented transversely to the clamping rail 14. As a result, this first contact bar 46 is mounted on the actuating device 12 for rotation with the clamping rail 14 via its rotatable mounting by means of the first bearing element 18, the second bearing element 34 and the deep-groove bearings 36 and 40 but is not displaceable in relation to this device.

In a variation of one embodiment, a rotary bearing 47 is non-rotatably seated on the deep-groove bearing 40 so that this rotary bearing 47 is rotated with the clamping rail 14. The first contact bar 46 is held for rotation in this rotary bearing 47, wherein it can be fixed in its rotatability in the rotary bearing 47, for example, by means of friction or form locking. As a result, the first contact bar 46 can be turned as a whole with rotation of the clamping rail and independently thereof relative to the clamping rail about the rotary bearing 47.

A second contact element 48 faces the first contact bar 46 on the clamping rail 14 and is held, in particular, at one end thereof, for example, by way of form locking. The distance between the first contact bar 46 and the second contact element 48 may be altered as a result of displacement of the clamping rail 14. The two contact elements 46 and 48 are aligned in a defined orientation relative to one another and, in particular, are aligned essentially parallel or at a slight inclination to one another. As a result of an inclination of one contact element and, in particular, of the first contact element 46, the clamping effect on a workpiece between the contact elements can be increased.

Figure 2:
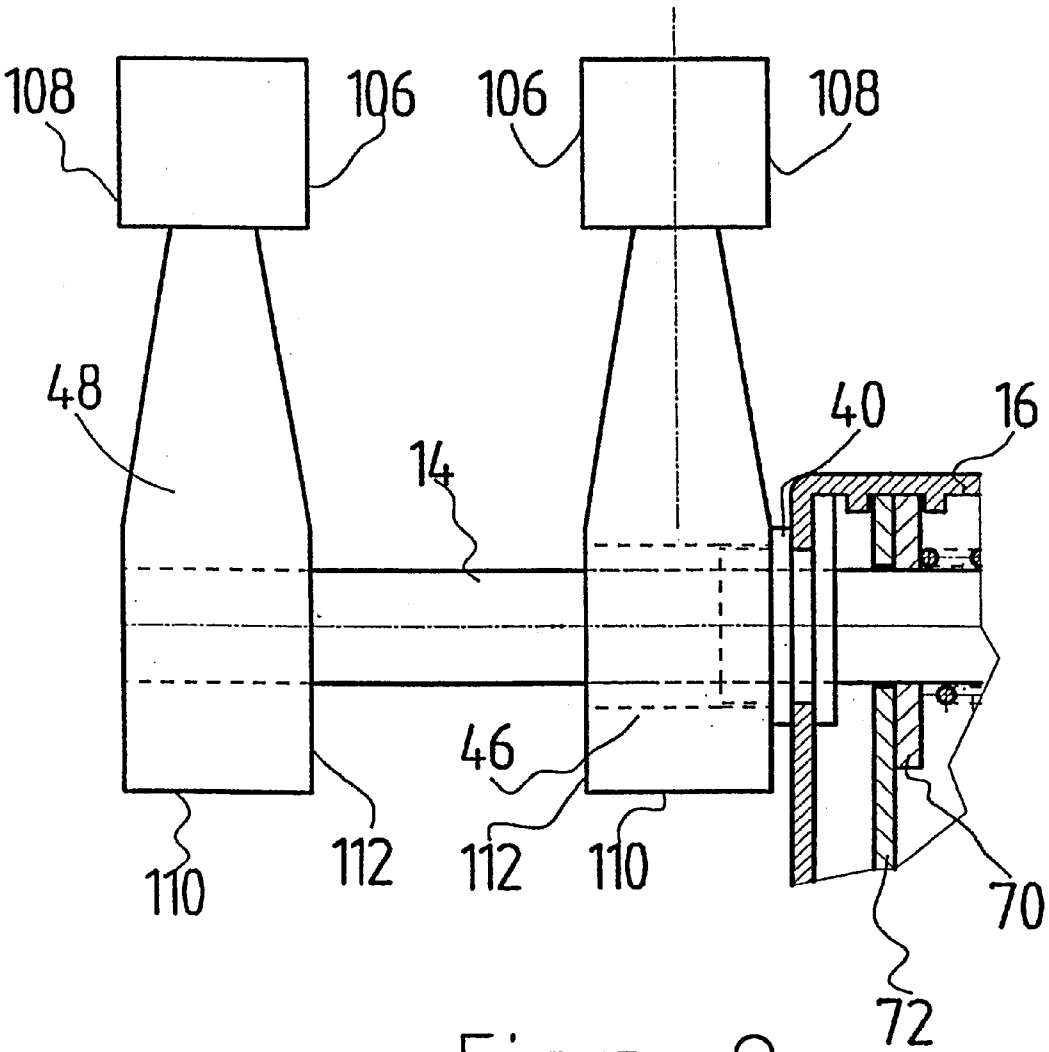
FIG. 2: shows a side view of contact elements of an inventive clamping device.

It may be provided for the second contact element 48 to be designed as a contact bar (FIG. 2). In one variation of one embodiment, the second contact element is designed, in particular, as a circular contact disk 49 (FIGS. 8, 9) which is held centrally on the clamping rail 14. In this respect, an annular contact member 51 may be formed on the contact disk 49 facing the first contact element in order to make a contact surface available which corresponds to that of the first contact element, in particular, with respect to the dimensions in a radial direction. The contact member 51 and a contact surface of the first contact element are preferably aligned with one another.

A first blocking element 52, which is rotatable in relation to the housing 16 and essentially of the same design as the first bearing element 18, is optionally arranged in a recess 50 of a wall of the housing 16, in which the first deep-groove bearing 36 is seated at one end, so as to be located opposite this first deep-groove bearing 36. A first holding element 54 is associated with the first blocking element 52 and the first blocking element 52 can be abutted on this holding element. This first holding element 54 has an opening 56 for the clamping rail 14, in which this is rotatable. It extends transversely to the clamping rail 14 through the housing 16 and exits from it at an opening 58 so that the first holding element 54 can be moved from outside the housing 16.

The first holding element 54 has a holding member 60 which is, for example, of a flat design, a guiding member 62 which is arranged at an angle, for example, in the order of magnitude of 20° towards the first blocking element 52 and, in addition, a gripping member 64 which is essentially parallel to the holding member 60 and projects out of the housing 16 via the opening 58 so that the first holding element 54 can be moved (in particular, in the direction towards the first bearing element 18). The function of the guiding member 62 will be explained in greater detail in the following.

The first holding element 54 can be brought into a position 66 (indicated by dashed lines in FIG. 1), in which the holding member 60 is aligned at right angles to the clamping rail 14 and can be fixed in this position. As a result, the first blocking element 52 is also aligned at right angles to the clamping rail 14 and the clamping rail 14 is, as a result, not locked in position by the first blocking element 52, i.e., its displaceability is not impeded.

A pressure spring 68 is arranged between the first bearing element 18 and the first blocking element 52 and this spring exerts a force on the first blocking element 52 in the direction away from the first bearing element 18, presses the first blocking element 52 against the holding element 54 and, in particular, tilts it away from the first bearing element 18 when the first holding element 54 is not in its vertical position 66. The pressure spring 68 is, in particular, in a position to tilt the blocking element 52 and the first holding element 54 to such an extent that the blocking element 52 blocks the displacement of the clamping rail 14 in the direction A.

In the same way as a first blocking element 52 is associated with the first bearing element 18, a second blocking element 70, a second holding element 72 and a second pressure spring 73 between the second blocking element 70 and the second bearing element 34 are associated with the second bearing element 34.

The second holding element 72 is, in the embodiment shown in FIG. 1, of the same design as the first holding element 54 and arranged in the same orientation (i.e. not in mirror symmetry in relation to the central plane 30). A guiding member 74 of the second holding element 72 is therefore arranged at a small angle in relation to a holding member 76 away from the second bearing element 34.

The second holding element 72 and thus the second blocking element 70, as well, may be tilted in a direction away from the second bearing element 34 in order to lock the clamping rail 14 in position accordingly. The first blocking element 52 and the second blocking element 70 can therefore be tilted in opposite directions.

A gripping element 77 is arranged on the housing and has a first gripping lever 78 which is arranged so as to be pivotable and acts on the first bearing element 18 and a second gripping lever 80 which acts on the second bearing element 34. The first gripping lever may be pivoted about a pivot axis 82 in the direction of the first gripping lever 78, i.e., in a direction away from the first bearing element 18. The second gripping lever 80 may be pivoted in the direction of the first gripping lever 78, i.e., away from the second bearing element 34.

In the case of the embodiment of an inventive clamping device shown in FIG. 1, the two gripping levers 78 and 80 have the common pivot axis 82.

The first gripping lever 78 and the second gripping lever 80 are each designed as twin armed levers with a respective eccentric element 84 and 86 which acts on the associated first bearing element 18 and the second bearing element 34, respectively, during pivoting of the associated gripping lever in order to tilt this element against the clamping rail 14 and move it in a direction of displacement of the clamping rail in order to bring about the displacement itself of the clamping rail 14. The bearing elements 18 and 34 therefore act as advancing elements for the clamping rail 14, wherein this advancing takes place contrary to the force of the pressure springs 68 and 73, respectively.

The gripping element 77 is designed such that it can be placed in one hand of a user and can be operated with one hand; i.e., the clamping device represents a one-handed clamping device. In order to displace the clamping rail in a certain direction, for example, in the direction A according to FIG. 1, during which the two contact elements 46 and 48 are moved towards one another (and therefore a workpiece can be clamped between these two contact elements), one gripping lever is stationary and the other gripping lever is pivotable. In particular, for the displacement in the direction A according to FIG. 1 the second gripping lever 80 is stationary and the first gripping lever 78 can be pivoted towards the second gripping lever 80. For displacement in the opposite direction B, during which the two contact elements 46 and 48 are moved apart from one another in order to use the clamping device for spreading, the first gripping lever 78 is stationary and the second gripping lever 80 may be pivoted in the direction of the first gripping lever 78 about the pivot axis 82.

Figure 3:
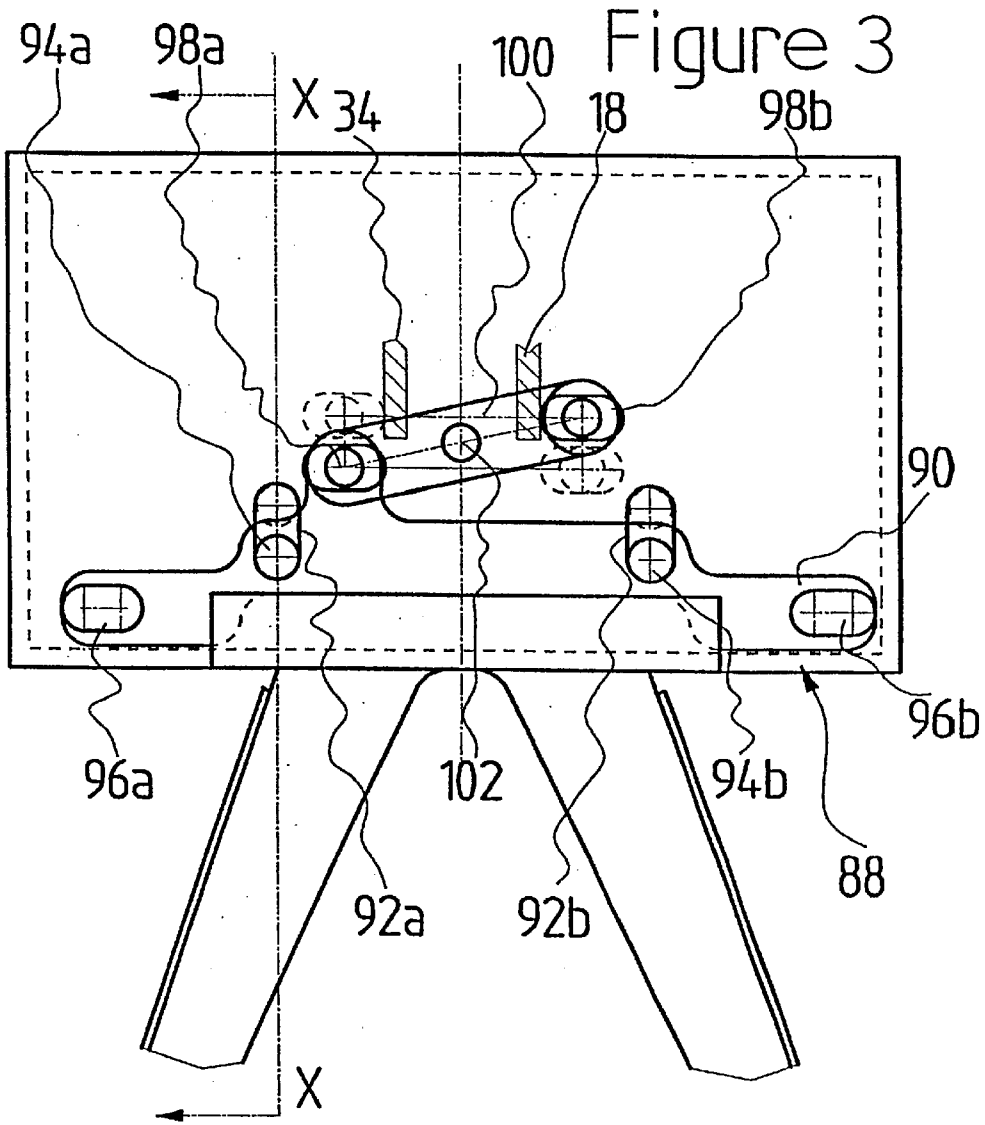
FIG. 3: shows a sectional side view of an actuating device according to FIG. 1 which shows a change-over device for changing the direction of displacement of a clamping rail.
Figure 6:
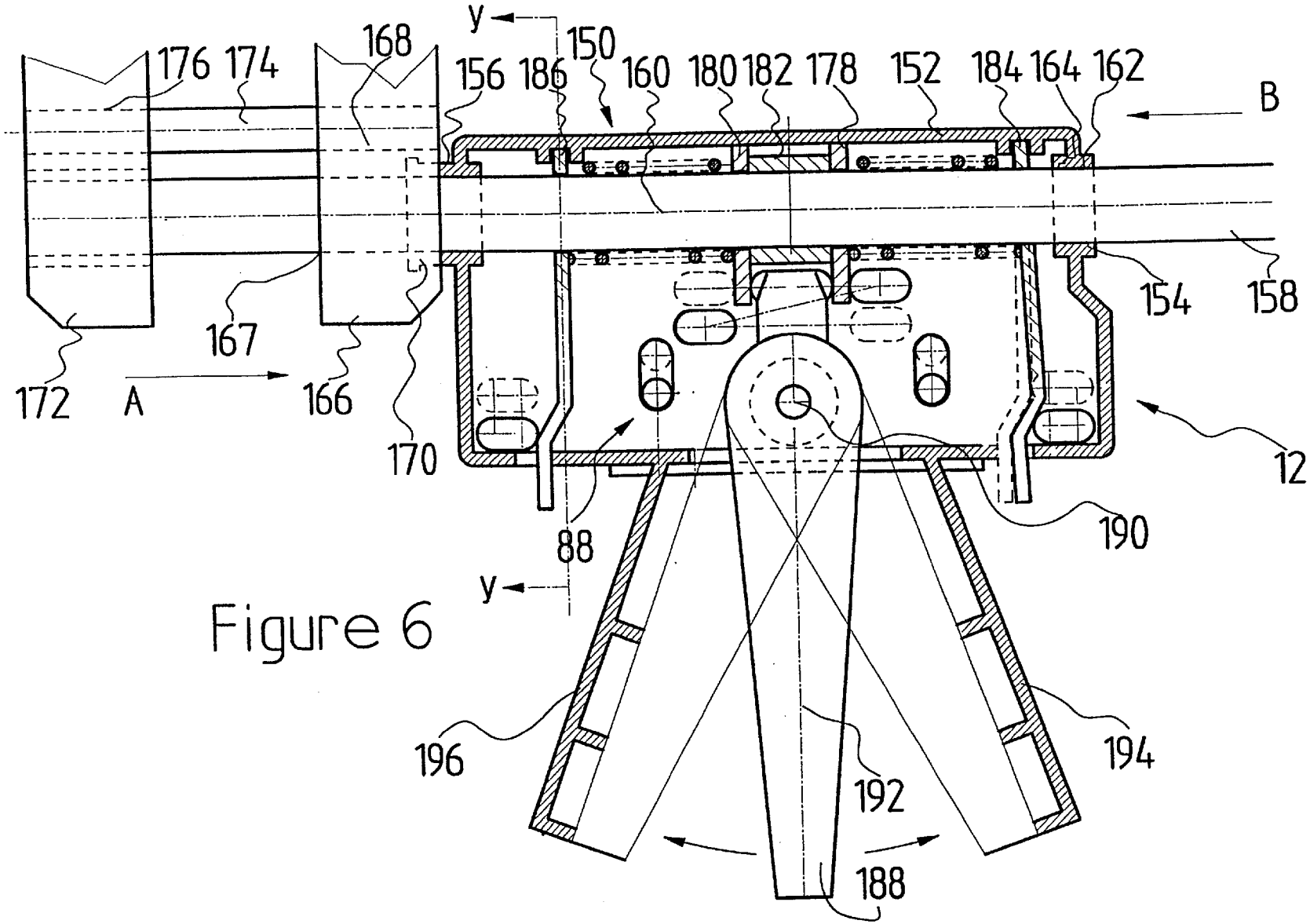
FIG. 6: shows a sectional view of a third embodiment of an inventive clamping device.

In order to bring about a displacement of the clamping rail 14 in only one direction A or B via the gripping element 77, a coupling device which is designated in FIGS. 1, 3 and 6 as a whole as 88 is provided as a change-over device for the direction of displacement.

In a variation of one embodiment, the coupling device 88 comprises, as shown in FIG. 3, a slide element 90 which is arranged on the housing 16 of the actuating device 12 so as to be displaceable as a whole transversely to the longitudinal direction of the clamping rail 14. For this purpose, spaced parallel guiding grooves 92*a*, 92*b* are formed on the housing and these are aligned at right angles to the directions of displacement A and B, respectively, and a respective guiding pin 94*a*, 94*b* of the slide element 90 engages in them.

Furthermore, holding noses 96*a* and 96*b* are arranged on the slide element 90 and these serve for the positioning of the second holding element 72 and the first holding element 54, respectively. They are arranged such that only one of the two holding elements 54 and 72 is located in a vertical position 66, i.e., either the first holding element 54 is in such a position and the second holding element 72 is titled (for a displacement of the clamping rail 14 in the direction B) or the second holding element 72 is tilted and the first holding element is in its vertical position 66 (for a displacement in the direction A). The two holding noses 96*a* and 96*b* have for this purpose essentially the same distance from the clamping rail 14. They engage on the respective guiding member 62, 74 of the first holding element 54 or the second holding element 72 which serves to transfer the holding noses 96*a*, 96*b* between a fixing position for the holding element 72 and 54, respectively, and a non-holding position.

Furthermore, the slide element 90 comprises holding noses 98*a* and 98*b* which serve as a means for securing against tilting for the first bearing element 18 (holding nose 98*b*) or the second bearing element 34 (holding nose 98*a*), respectively. The holding noses 98*a* and 98*b* are arranged and designed such that either the first bearing element 18 is secured against any tilting and displacement (during the displacement of the clamping rail in the direction B) or the second bearing element 34 is protected against any tilting and displacement (during the displacement in the direction A).

In FIGS. 1 and 3, a means for securing against tilting is shown by solid lines which allows only a displacement in the direction B and a means for securing against tilting by dashed lines which allows only a displacement in the direction A. For this purpose, the two holding noses 98*a* and 98*b* are connected via a bridge element 100 (FIG. 3) which is articulatedly connected to the housing 16 between the eccentric elements 84 and 86 so as to be rotatable with an axis of rotation 102 parallel to the pivot axis 82 and is likewise rotatably articulated to the first holding nose 98*a*. If the slide element 98 is then displaced with the holding nose 98*a*, the holding nose 98*b* is also displaced via the turned bridge element 100 transversely to the clamping rail 14, namely in such a manner that during the movement of the slide element 90 into a holding position in relation to the second bearing element 34 the holding nose 98*a* is displaced into a holding position for the second bearing element 34 and the holding nose 98*b* out of a holding position for the first bearing element 18; during a corresponding, reverse displacement of the slide element 90 the relationships are reversed.

As a result of displacement of the slide element 90, the corresponding holding element is displaced into its vertical position at the same time (if a displacement of the clamping rail 14 is intended to be allowed in the direction B, the second holding element 72, if it is intended to be displaced in the direction A, the first holding element 54).

In a preferred variation of one embodiment, the first contact element 48 and the second contact element 46 are essentially of the same design. Each contact element has, in particular, essentially the same first contact surface 106 which is arranged so as to face the other contact element and a second contact surface 108 which is arranged so as to face away from the other contact element (FIG. 2). As a result, the inventive clamping device can be used advantageously for clamping (locking in position) and for spreading apart. Furthermore, it is provided for the two contact elements 48 and 46 to have plane lower surfaces 110 which are oriented so as to be in alignment and on which the contact elements 48 and 46 can be placed. It is likewise provided in a variation of one embodiment for at least one section of that surface 112 of a contact element which faces the other contact element to be of a flat design and, in particular, at right angles to the clamping rail 14 so that, in this case, as well, a support surface is formed, with which the contact elements 48 and 46 can be abutted on a workpiece.

The inventive clamping device functions as follows:

A user sets the direction of displacement of the clamping rail 14 via the slide element 90 of the change-over device. In its lower position (shown in solid lines in FIGS. 1, 3 and 4) the clamping rail 14 may be displaced in the direction B, i.e., the two contact elements 48 and 46 may be moved away from one another. If, proceeding from this position, the slide element 90 is displaced upwards, the direction of displacement may be switched over to the opposite direction A, with which the two contact elements 48 and 46 can be moved towards one another.

In the lower position of the slide element 90 for the displacement in the direction B, the pivoting of the first gripping lever 78 is blocked. The first bearing element 18 is oriented at right angles to the longitudinal direction of the clamping rail 14. In this position of the slide element 90, the first holding element 54 is not in the position 66 and so the first blocking element 52 is tilted contrary to the direction of displacement and thus locked in position against the clamping rail 14. As a result, the displacement of the clamping rail 14 in the direction A is blocked.

By actuating the second gripping lever 80, a force is exerted on the second bearing element 34 via the eccentric element 86, this bearing element tilts in the direction of force and is locked in position against the clamping rail 14. As a result, the second bearing element 34 which acts as an advancing element is moved further during further force exertion via actuation of the second gripping lever 80 and on account of the locking in position with the clamping rail 14 this is displaced. The bearing element 34 is thus an advancing bearing.

The second gripping lever 80 can be pivoted only up to a certain pivot angle. When the user releases this second gripping lever 80, the second pressure spring 73 pushes the second bearing element 34 back into its initial position. Since it is no longer acted upon by pressure via the second gripping lever 80, the tilting is also released which makes it possible for the bearing element 34 to be pushed back. It is ensured on account of the blocking position of the first blocking element 52 that the clamping rail 14 is not pushed back in the direction A during the return movement of the second bearing element 34. Since this first blocking element 52 is tilted in the direction A, a displacement in the direction B, as brought about via the second bearing element 34, acts contrary to this tilting and thus does not hinder the displacement in the direction B.

As a result of displacement of the slide element 90, the holding nose **96*b* is displaced along the guiding member 62 of the first holding element 54 such that it is displaced into the vertical position 66 and thus the first blocking element 52, as well. Furthermore, the holding nose 96*a* which has previously held the second holding element 76 in its vertical position is pushed outwards so that on account of the effect of the force of the second pressure spring 73 the second blocking element 70 and the second holding element 76 tilt. At the same time, the holding nose 98*a* is displaced towards the second bearing element 34 so that this can no longer tilt and the pivotability of the second gripping lever 80 is blocked. As a result of the displacement of the holding nose 98*a*, the holding nose 98*b* is pivoted out of its blocking position on the first bearing element 18** and this is released as a result.

The first gripping lever 78 may then be pivoted against the second gripping lever 80, the first bearing element 18 tilted as a result and on account of its design as an advancing element the clamping rail 14 displaced in the direction A in order to move the two contact elements 46 and 48 towards one another.

The displacement in the direction B is blocked on account of the tilting of the second blocking element 70 in the direction B.

On account of its rotatable mounting, the clamping rail 14 is unlimitedly rotatable, i.e., through any optional angle irrespective of the position of the slide element 90 in relation to the housing 16 of the actuating device 12. As a result, an adjusted alignment of the two contact elements 46 and 48 relative to one another is maintained even during rotation of the clamping rail 14.

Figure 5:
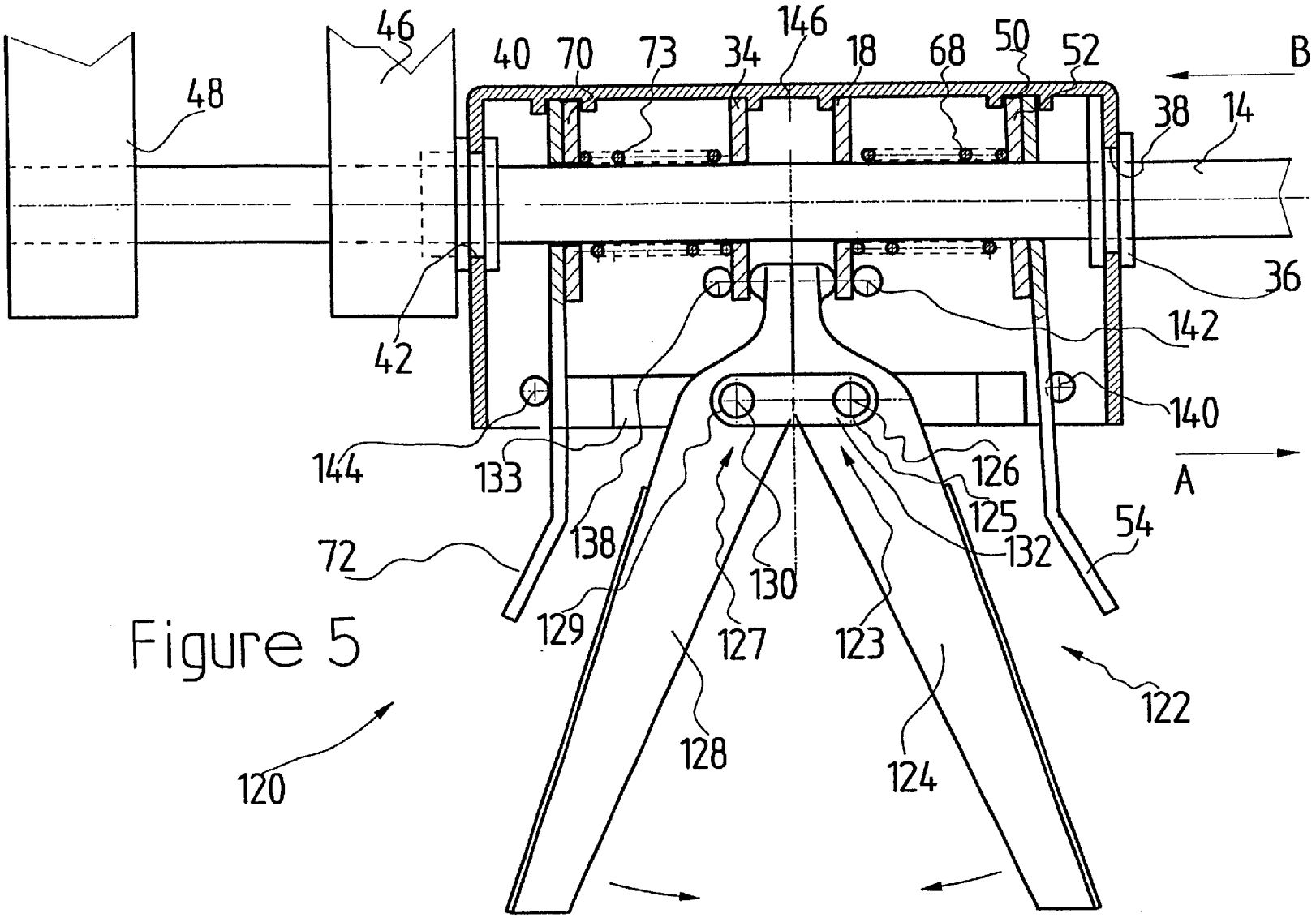
FIG. 5: shows a view of a second embodiment of an inventive clamping device, with which a housing of an actuating device is shown open.

In a second embodiment of an inventive clamping device which is designated in FIG. 5 as a whole as 120, the advancing/restoring mechanism for the displacement of the clamping rail is, in principle, of the same construction as that already described in conjunction with the first embodiment according to FIGS. 1 to 4. Structural elements which are of the same design therefore have the same reference numerals in FIG. 5 as in FIGS. 1 to 4.

In the case of the clamping device 120, a gripping element 122 is provided with a first gripping lever 124 which is arranged so as to be pivotable about a first pivot axis 128 and a second gripping lever 128 which is articulated for pivoting about a second pivot axis 130 which is parallel and at a distance to the first pivot axis 126. A pivot bearing 123 for the first gripping lever 124 is formed by a pin 125, about which the first gripping lever 124 is rotatable. A similar pivot bearing 127 with a pin 129 is formed for the second gripping lever 128 in the same way. A bridge element 132 is pushed over the pins 125 and 129 in order to couple the two gripping levers 124 and 128 to one another.

The housing 16 has a recess 133, in which at least one of the bridge elements 132 is guided for displacement parallel to the clamping rail 14; as a result, in the case of a force acting on a gripping lever 124 and 128, respectively, not only pivoting is brought about but the two coupled gripping levers 124 and 128 are displaced with one another via the bridge element or elements 132. A displacement of the bridge element 132 in the direction of the displacement of the clamping rail 14 may then be brought about via the pivoting of the gripping lever 124 and 128, respectively, whereby with the same pivot angle a longer path of displacement of the clamping rail 14 is achieved since, to a certain extent, the gripping lever 124 and 128, respectively, follows the advancing element 18 and 34, respectively. A rocker arm path for the gripping levers 124 and 128 is thus formed. As a result of the linear guidance of the gripping levers 124 and 128, during the pivoting of one gripping lever 124 or 128 for the displacement of the clamping rail 14 in the direction A or B the other gripping lever 128 or 124 is pivoted with it to a certain extent, namely in the opposite direction to the actuating gripping lever 124 or 128.

Furthermore, recesses 138 and 140 associated with one another and recesses 142 and 144 associated with one another are provided in the housing 16. A pin which blocks the tilting of the second bearing element 34 may be inserted into the recess 138. In a similar manner, a pin which blocks the tilting of the first bearing element 18 may be inserted into the recess 142. A pin may be inserted into the recess 140 which brings the first holding element 54 into a vertical position, in which the first blocking element 52 is in a non-blocking position for the displacement of the clamping rail 14. A pin may be inserted into the recess 144 which fixes the second holding element 72 in a vertical position, in which the blocking element 70 is not locked in position in relation to the clamping rail 14.

One coupling element is advantageously provided as a change-over element, for example, in the form of a bridge element which has a bar, on which pins are arranged at a specific distance (not shown in the Figures). This coupling element may then be arranged on the housing 16 such that in a first position the displacement of the clamping rail is possible in one direction and the displacement in the other is blocked and in a second position accordingly vice versa.

If, for example, the coupling element is arranged such that it is introduced into the recesses 138 and 140, a displacement of the clamping rail in the direction A is then possible.

If corresponding pins of the coupling element are inserted into the recesses 142 and 144, a displacement of the clamping rail in the direction B is then possible whereas the displacement in the direction A is blocked.

The coupling element thus forms, together with the recesses 138, 140, 142, 144, a change-over device for switching the direction of displacement of the clamping rail 14.

As for the rest, the clamping device 120 functions essentially the same as that described above for the clamping device 10.

The housing 16 is advantageously designed such that it comprises a first housing section 146 (cf., for example, FIG. 5) which is provided, for example, with recesses 38, 42, 50, into which the movable parts can be placed. By fixing a second housing section (not shown in the Figure) on the first housing section, these parts may be fixed in their recesses without them needing to be screwed. It is sufficient to merely connect the two housing sections to one another, for example, via screws. As a result, the production resources may be kept low.

In a third embodiment of an inventive clamping device which is designated in FIG. 6 as a whole as 150, respective rotary slide bearings 154 and 156 are arranged in a housing 152 so as to be located opposite one another and a clamping rail 158 is mounted in them so as to be not only rotatable about a longitudinal axis 160 but also slidingly displaceable in the direction of the longitudinal axis 160.

Such a rotary slide bearing 154 and 156, respectively, is formed by a circular recess 162, wherein a cylindrical flange 164 is seated around the circumference of the recess 162 in order to ensure the sliding displaceability of the clamping rail 158. The clamping rail 158 has a circular profile with oppositely located lateral recesses 165.

A first contact element 166 which is designed, in particular, as a contact bar is held on the housing 152 such that it is non-displaceable against this and thus the actuating device 12. As a result of a, for example, cylindrical recess 167 in the first contact element 166, the clamping rail 158 can be displaced relative to this first contact element 166. An annular recess 170 is provided, for example, in the first contact element 166 and a corresponding flange of the rotary slide bearing 156 dips into this recess in order to, on the one hand, ensure the rotatability of the first contact element 166 relative to the housing 152 and, on the other hand, to keep this non-displaceable in relation to the housing 152.

Figure 7:
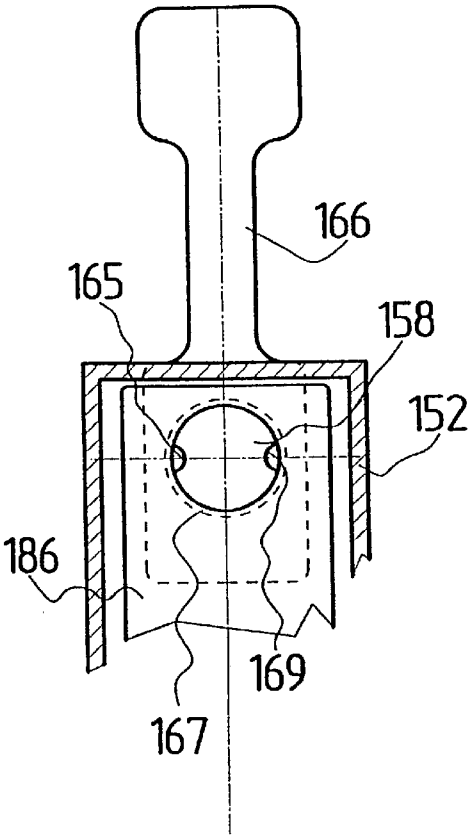
FIG. 7: shows a partial sectional view along line Y—Y in FIG. 6.

The first contact element 166 itself is held non-rotatably on the clamping rail 158 in a variation of one embodiment so that during rotation of the clamping rail 158 relative to the actuating device 12 the first contact element 166 is rotated with it. For this purpose, strips 169 which engage in the groove-like recesses 165 (FIG. 7) are seated in the recess 167 in the first contact element 166, by means of which the clamping rail 158 is guided, diametrically opposite.

A second contact element 172 is, in addition, held on the clamping rail 158 so as to be non-displaceable and, in particular, non-rotatable. This second contact element 172 can be designed as a contact bar.

In a variation of one embodiment, the first contact element 166 is arranged for rotation in relation to the clamping rail 158 in that, for example, no strips are seated in the recess 167 for engagement in the recesses 165 or the clamping rail 158 has no such recesses at all. An additional rotary bearing, as described in conjunction with the first embodiment (FIG. 1, rotary bearing 47) can also be provided.

A coupling rod 174 aligned, in particular, parallel to the clamping rail 158 is then arranged between the second contact element 172 and the first contact element 166 and couples the first contact element 166 to the second contact element 172 such that during a rotation of the clamping rail 158, during which the second contact element 172 is co-rotated, the first contact element 166 is co-rotated via the coupling with the coupling rod 174 and thus turned relative to the actuating device 12; as a result, the relative orientation between the two contact elements 166 and 172 is maintained during the rotation of the clamping rail 158 without the first contact element 166 being non-rotatably seated on the clamping rail 158. The coupling of the first contact element 166 via the coupling rod 174 to the second contact element 172 therefore blocks the free rotatability of the first contact element 166 about the clamping rail 158.

In order to be able to change the relative distance between the first contact element 166 and the second contact element 172 during a displacement of the clamping rail 158, the coupling rod 174 is guided via a guiding recess 176 for displacement in relation to the second contact element 172 or in relation to the first contact element 166 or in relation to both contact elements 166 and 172.

The mechanism for advancing the clamping rail 158 functions independently of the type of fixing of the first contact element 166 on the clamping rail 158 essentially in the same way as that already described in conjunction with FIG. 1. Advancing elements 178 and 180 are likewise provided, between which a block element 182 is arranged. The advancing elements 178 and 180 can each be titled against the clamping rail 158 in order to lock in position with this and in order to then be able to displace it in the direction A or B. The advancing elements 178 and 180 have central recesses, through which the clamping rail 158 is guided and in which this can be rotated relative to the advancing elements. (In an alternative embodiment, it may also be provided for the clamping rail 158 to be non-rotatably guided in the advancing elements 178, 180 in that, for example, holding elements of the advancing elements 178, 180 engage in the recesses 165 of the clamping rail 158. The advancing elements 178, 180 must then be mounted in the housing so as to be rotatable as a whole.)

Furthermore, holding elements 184 and 186 are provided which function in the same way as the holding elements 64 and 74 and the blocking elements according to FIG. 1. In the embodiment shown in FIG. 6, no separate blocking elements and holding elements as in FIG. 1 are provided but rather the holding elements 184 and 186 undertake not only the blocking function but also the holding function.

In the embodiment shown in FIG. 6, a gripping lever 188 is provided which is arranged on the housing 152 so as to be pivotable with a pivot axis 190 transversely to the direction of displacement of the clamping rail 158. This gripping lever 188 is pivotable in both directions of pivot. In a rest position it is aligned with a longitudinal axis 192 at right angles to the longitudinal axis 160 of the clamping rail 158, wherein in this orientation the longitudinal axis 192 is located, in particular, in a central plane of the housing 152.

Counterelements 194 and 196 are securely arranged on the housing 152, against which the gripping lever 188 can be pivoted and which serve as respective stationary handles.

The change-over device for blocking the displaceability of the clamping rail 158 in one direction and for switching over the blocking direction is, in principle, of the same design as that already described in conjunction with FIG. 1.

If the coupling device 88 is then adjusted such that the tilting of the advancing element 178 and its transport in the direction A is blocked, the advancing element 180 may be tilted due to pivoting of the gripping lever 188 towards the counterelement 196 and displaced in the direction B, whereby the clamping rail 158 is displaced in the direction B. Accordingly in the reverse case, the gripping lever 188 may be pivoted towards the counterelement 194 when the tilting of the advancing element 180 is blocked in order to be able to displace the clamping rail 158 in the direction A.

Figure 10:
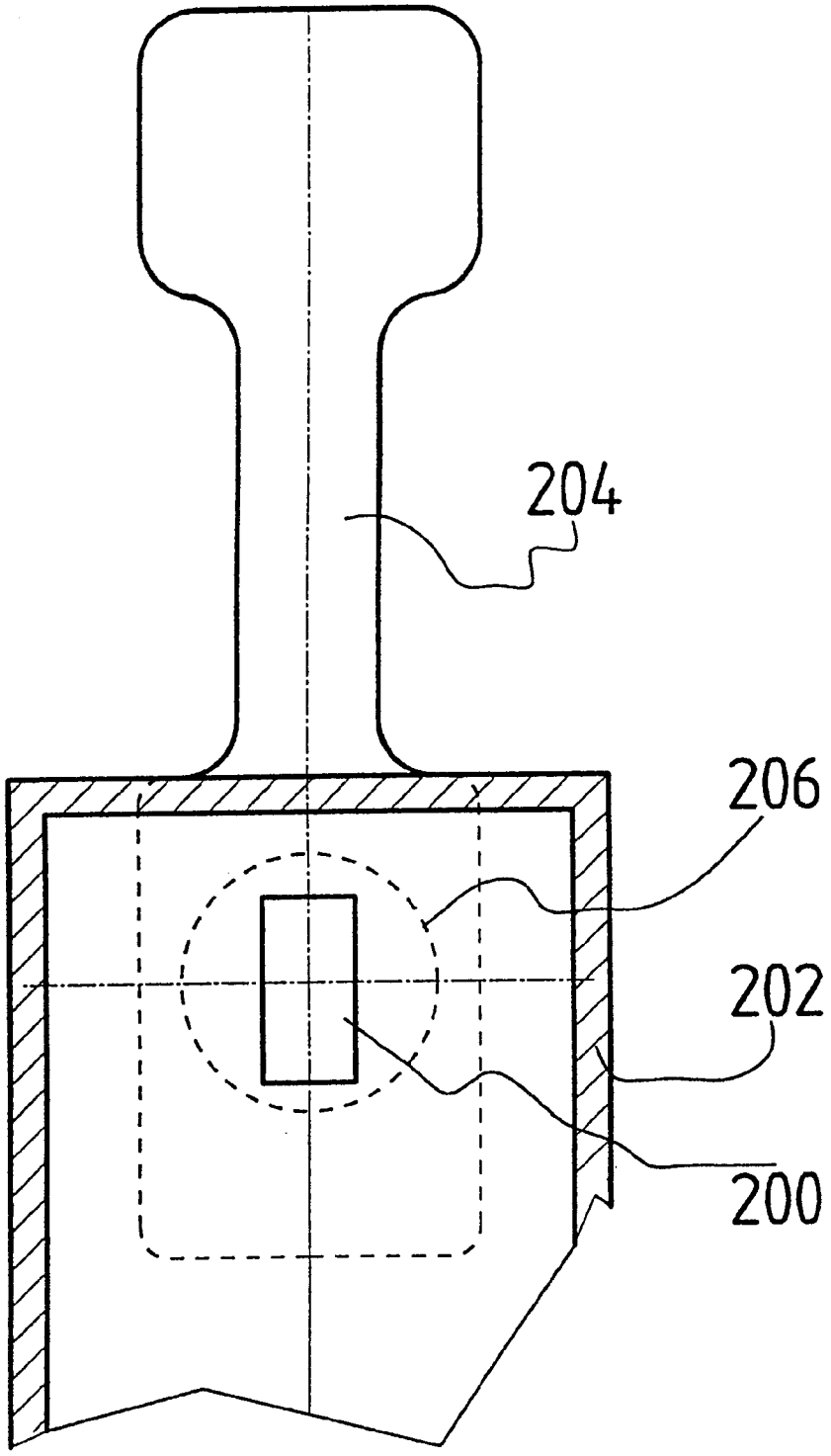

In a fourth embodiment which is shown schematically in FIG. 10 a clamping rail 200 is guided for sliding displacement but not rotatably in relation to a housing 202 of the actuating device 12. A first contact element 204 is seated on the clamping rail 200 so as to be non-displaceable in relation to the actuating device 12 and is, for example, rotatable via a rotary bearing 206 relative to it. The first contact element 204 is therefore rotatable relative to the actuating device.

Figure 8:
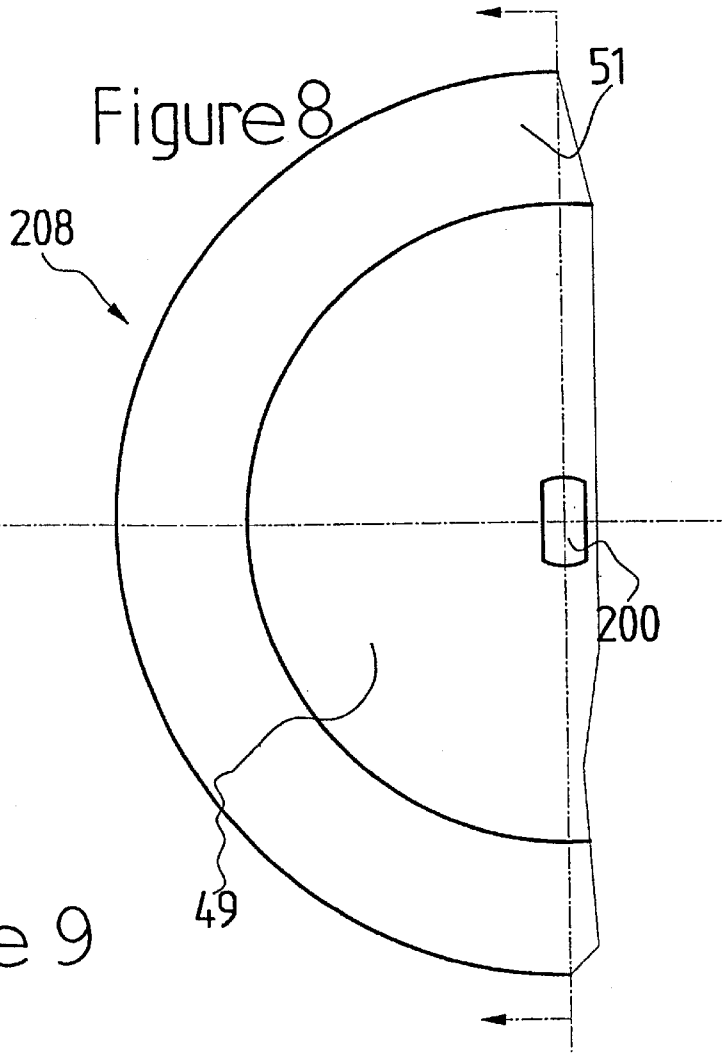
FIG. 8: shows a partial view of an alternative embodiment of a contact element.
Figure 9:
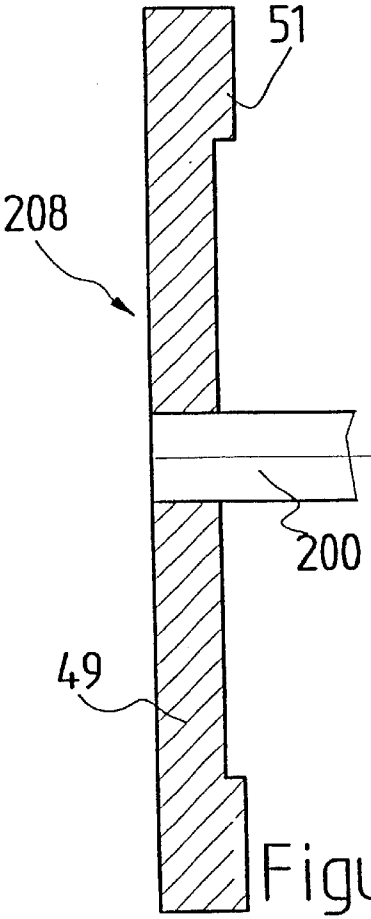
FIG. 9: shows a side view of the contact element according to FIG. 8 and FIG. 10: shows a front partial sectional view of a fourth embodiment of an inventive clamping device.

A second contact element 208 is seated non-rotatably on the clamping rail 200 and this is designed, in particular, in axial symmetry about a longitudinal axis of the clamping rail 200 (FIGS. 8, 9). The contact element has, for example, a configuration already described above in conjunction with the contact element 49. As a result of the rotation of the first contact element 204 relative to the second contact element 208, their relative orientation is nevertheless maintained due to the symmetrical design of the second contact element 208.

The advancing mechanism for the clamping rail 200 is, in principle, of the same design as that described in conjunction with the other embodiments.

What is claimed is:

1. Clamping device with a clamping rail guided for displacement in its longitudinal direction and an actuating device comprising a gripping element, the clamping rail being displaceable by said gripping element, wherein a first contact element and a second contact element are held on the clamping rail, wherein the clamping rail is displaceable in relation to the first contact element and wherein the first contact element is rotatable relative to the actuating device.

2. Clamping device as defined in claim 1, wherein the clamping rail is guided so as to be non-rotatably displaceable.

3. Clamping device as defined in claim 1, wherein the clamping rail is mounted for rotation on the actuating device, wherein first and second contact elements are rotatable with the clamping rail.

4. Clamping device as defined in claim 3, wherein the clamping rail is unlimitedly rotatable with the contact elements held on it.

5. Clamping device as defined in claim 1, wherein the clamping rail is guided for displacement by at least one bearing element.

6. Clamping device as defined in claim 5, wherein the bearing element is mounted for rotation on the actuating device.

7. Clamping device as defined in claim 5, wherein a bearing element guides the clamping rail so as to be non-rotatable and slidingly displaceable.

8. Clamping device as defined in claim 5, wherein the clamping rail has a profile designed such that the rotatability of the clamping rail is blockable in relation to a bearing element guiding the clamping rail for displacement.

9. Clamping device as defined in claim 8, wherein the clamping rail has a flat profile.

10. Clamping device as defined in claim 5, wherein a bearing element guides the clamping rail so as to be rotatable and slidingly displaceable.

11. Clamping device as defined in claim 5, wherein at least one bearing element is designed as a deep-groove bearing arranged on the housing of the actuating device so as to be non-displaceable and rotatable by means of a groove.

12. Clamping device as defined in claim 11, wherein the first contact element is held on the actuating device via a deep-groove bearing so as to be non-displaceable and rotatable with the clamping rail.

13. Clamping device as defined in claim 1, wherein the gripping element comprises a handle arranged on the actuating device so as to be pivotable.

14. Clamping device as defined in claim 1, wherein at least one advancing element is provided, said advancing element being arranged and designed such that it is tiltable contrary to the direction of displacement of the clamping rail in order to block the displaceability of the clamping rail in relation to the advancing element, and wherein it is movable in the direction of displacement of the clamping rail.

15. Clamping device as defined in claim 14, wherein an advancing element is arranged in a housing of the actuating device so as to be rotatable.

16. Clamping device as defined in claim 14, wherein an advancing element is tiltable and movable via a force acting on it by way of the gripping element.

17. Clamping device as defined in claim 14, wherein a pressure spring is arranged between an advancing element and a blocking element or holding element for exerting a restoring force on the advancing element contrary to the direction of displacement.

18. Clamping device as defined in claim 17, wherein the blocking element is arranged in the housing of the actuating device so as to be rotatable.

19. Clamping device as defined in claim 17, wherein the blocking element and/or holding element is adapted to be brought into a blocking position blocking displaceability of the clamping rail in one direction.

20. Clamping device as defined in claim 1, wherein a holding element is provided for blocking the displaceability of the clamping rail in one direction.

21. Clamping device as defined in claim 20, wherein the holding element is actuatable independently of the gripping element.

22. Clamping device as defined in claim 20, wherein the holding element is arranged so as to be non-rotatable in relation to the actuating device.

23. Clamping device as defined in claim 21, wherein the holding element is adapted to be fixed in a holding position, wherein a blocking element possibly provided is in a non-blocking position in the holding position.

24. Clamping device as defined in claim 23, wherein the holding element is adapted to be fixed in a holding position, the holding element being aligned essentially at right angles to the clamping rail in said position.

25. Clamping device as defined in claim 23, wherein the holding element is adapted to be fixed in its holding position by means of a coupling pin.

26. Clamping device as defined in claim 1, wherein a contact surface for an advancing element limiting the displaceability of the advancing element in a direction contrary to the direction of displacement of the clamping rail is formed in a housing of the actuating device.

27. Clamping device as defined in claim 1, wherein the actuating device is designed to be essentially in mirror symmetry to a central plane transversely to the direction of displacement of the clamping rail.

28. Clamping device as defined in claim 1, wherein a displacement of the first and the second contact elements towards one another and away from one another is actuatable via the gripping element.

29. Clamping device as defined in claim 1, wherein a first advancing element for the displacement of the clamping rail in a first direction of displacement and a second advancing element for the displacement in an opposite direction are provided.

30. Clamping device as defined in claim 29, wherein first and second advancing elements are adapted to be tilted in opposite directions.

31. Clamping device as defined in claim 29, wherein a first gripping lever of the gripping element engages on the first advancing element and a second gripping lever engages on the second advancing element.

32. Clamping device as defined in claim 31, wherein first and second gripping levers are pivotable in opposite directions for engagement on the associated advancing elements.

33. Clamping device as defined in claim 29, wherein a gripping lever is provided for displacing the first advancing element or the second advancing element depending on the direction of pivoting.

34. Clamping device as defined in claim 29, wherein:

a first pressure spring and a first holding element are associated with the first advancing element; and a second pressure spring and a second holding element are associated with the second advancing element.

35. Clamping device as defined in claim 34, wherein first and second holding elements are adapted to be coupled to one another such that when the first blocking element is in a blocking position the second blocking element is in a non-blocking position and vice versa.

36. Clamping device as defined in claim 35, wherein the first blocking element in its blocking position is tilted in a direction opposite to the second advancing element during its displacement and accordingly the second blocking element is titled in a direction opposite to the first advancing element during its displacement.

37. Clamping device as defined in claim 35, wherein a coupling device is provided, said coupling device being adapted to be secured in a first position on the actuating device, the first blocking element being fixed in a non-blocking position via the associated first holding element and the second blocking element being in a blocking position in said first position, and being adapted to be secured in a second position, the first blocking element being in a blocking position and the second blocking element being fixed in a non-blocking position via the associated second holding element in said second position.

38. Clamping device as defined in claim 37, wherein in the first position of the coupling device the second advancing element is secured against tilting and in the second position the first advancing element is secured against tilting.

39. Clamping device as defined in claim 1, wherein a housing of the actuating device is designed and provided with recesses such that the movable parts are fixed in relation to the housing solely via the recesses acting as contact surfaces.

40. Clamping device as defined in claim 39, wherein the housing of the actuating device comprises a first housing section and a second housing section adapted to be fixed to one another.

41. Clamping device as defined in claim 1, wherein at least one of the first contact element or the second contact element are designed as a contact bar.

42. Clamping device as defined in claim 1, wherein at least one of the first contact element or the second contact element are designed as a contact disk.

43. Clamping device as defined in claim 1, wherein a contact element has contact surfaces of essentially the same design transversely to the longitudinal direction of the clamping rail.

44. Clamping device as defined in claim 1, wherein the first contact element and the second contact element have contact surfaces of essentially the same design.

45. Clamping device as defined in claim 1, wherein at least one of the first contact element or the second contact element are rotatable in relation to the clamping rail.

46. Clamping device as defined in claim 1, wherein a coupling element is provided for coupling the first contact element and the second contact element to one another such that they are turned with the clamping rail during rotation thereof.

47. Clamping device as defined in claim 1, wherein the first contact element is held on the clamping rail by means of a rotary bearing.

48. Clamping device as defined in claim 34, wherein:

a first blocking element is associated with the first advancing element; and a second blocking element is associated with the second advancing element.

* * * * *

UNITED STATES PATENT AND TRADEMARK OFFICE

CERTIFICATE OF CORRECTION

PATENT NO. : 6,601,837 B2
DATED : August 5, 2003
INVENTOR(S) : Klimach et al.

It is certified that error appears in the above-identified patent and that said Letters Patent is hereby corrected as shown below:

Title page,
Item [73], Assignee, delete the "," after "Co" in assignee's name Column 17,
Line 55, change "34" to -- 48 --

Signed and Sealed this

Twentieth Day of January, 2004

JON W. DUDAS
*Acting Director of the United States Patent and Trademark Office*